US005417161A

United States Patent [19]

Sanai et al.

[11] Patent Number: 5,417,161

[45] Date of Patent: May 23, 1995

[54] FABRICATION OF MOLDED BLOCK OF DILUTE HIGH EXPLOSIVE FOAMED POLYURETHANE

[75] Inventors: Mohsen Sanai, Palo Alto; S. Thomas Gaines, Pleasanton; Gary R. Greenfield, San Jose, all of Calif.

[73] Assignee: SRI International, Menlo Park, Calif.

[21] Appl. No.: 21,393

[22] Filed: Feb. 23, 1993

[51] Int. Cl.[6] ..... C06B 45/00; C06B 21/00

[52] U.S. Cl. ..... 102/290; 102/289; 264/3.1

[58] Field of Search ..... 269/3.1; 102/289, 290

[56] References Cited

U.S. PATENT DOCUMENTS

| | | | |
|---|---|---|---|
| 2,768,072 | 10/1956 | Stark | 52/5 |
| 2,845,025 | 7/1958 | Stark | 102/10 |
| 3,198,677 | 8/1965 | Thomas | 149/19 |
| 3,308,210 | 3/1967 | Ross | 264/3.1 |
| 3,902,933 | 9/1975 | Chandler | 149/2 |
| 4,151,022 | 4/1979 | Donaghue et al. | 149/19.4 |
| 4,722,280 | 2/1988 | Sanai | 102/289 |
| 4,964,329 | 10/1990 | Moxon et al. | 86/50 |
| 5,149,911 | 9/1992 | Ringbloom et al. | 102/302 |
| 5,189,247 | 2/1993 | Andre et al. | 102/291 |

*Primary Examiner*—Peter A. Nelson
*Attorney, Agent, or Firm*—John P. Taylor

[57] ABSTRACT

A process, apparatus, and composition are disclosed for forming a molded foamed polyurethane explosive block with pentaerythritol tetranitrate in a manner in which the generation of excessive exothermic heat is inhibited during the reaction to form the foamed polyurethane. In one aspect of the invention, the exothermic heat generation is controlled by the use of non-reactive filler materials. In a preferred embodiment, a monoammonium phosphate filler is used to further impart fire retardant properties to the resultant molded foam explosive block. In another aspect of the invention, the reactants are introduced into a mixing chamber by remote control, wherein the mold itself forms a bottom wall of the mixing chamber, and the remainder of the mixing chamber is portable and is removed from the mold, after the reactants used to form the foamed polyurethane and the pentaerythritol tetranitrate explosive have been mixed together, to thereby eliminate the need to transfer the mixture from a mixing chamber into a mold while the thermosetting reactants are reacting to form the foamed polyurethane.

20 Claims, 3 Drawing Sheets

FABRICATION OF MOLDED BLOCK OF DILUTE HIGH EXPLOSIVE FOAMED POLYURETHANE

BACKGROUND OF THE INVENTION

1. Field of the Invention

This invention relates to the formation of a molded block of dilute high explosive foamed polyurethane. More particularly, this invention relates to an improved process, composition, and apparatus for the formation of a molded block of dilute high explosive foamed polyurethane.

2. Description of the Related Art

The formation of molded explosives incorporated into foamable plastic materials is known. For example, Stark U.S. Pat. No. 2,768,072 describes the formation of a foamed explosive using either a foamed thermosetting polyester resin cross-linked with styrene, a polyurethane foam resin formed from toluene diisocyanate and alkyd resins, a foamed polyvinyl chloride, or a foamed epoxy resin.

Stark U.S. Pat. No. 2,845,025 also discloses a foamed explosive using a thermosetting polyester resin using however, methyl methacrylate, either in monomeric or polymeric form, instead of styrene, as the cross-linking agent.

Thomas U.S. Pat. No. 3,198,677 describes a solid self-combustible cellular organic polymer composition in which the composition forms the cells walls of an integral foamed cellular structure. The self-combustible composition comprises an inert organic polymer binder, such as foamed polyurethane; and a finely divided oxidizer, such as pentaerythritol tetranitrate (PETN), dispersed in the binder.

Donaghue et al. U.S. Pat. No. 4, 15 1,022 discloses an explosive composition wherein a particulate explosive is dispersed in a foamed non-explosive matrix such as polyurethane.

Sanai U.S. Pat. No. 4,722,280 describes the formation of a molded low density explosive member by first mixing together an explosive powder and polystyrene beads, and then heating the mixture to foam the polystyrene beads to form the molded low density structure.

In some respects, processes which involve the use of thermosetting reactants such as, for example, the above described processes for forming a foamed polyester, epoxy, or polyurethane matrix for the explosive, are preferred over the use of foamable thermoplastics such as foamable styrene, because no heat need be supplied to the system. However, the amount of heat generated by such exothermic processes, and the need to somehow control the temperature of the thermosetting reaction while such heat is being generated, introduces additional safety problems when one is forming explosive materials.

For example, temperatures in excess of 230° C. may be encountered during the exothermic reaction to form a foam polyurethane, while the melting point of pure pentaerythritol tetranitrate (PETN) is only 141° C.

Therefore, while the prior art describes the formation of explosive compositions using foamed thermosetting organic binders such as polyurethane, in actual practice, safety considerations have inhibited the formation of molded foamed explosive blocks using organic binders such as polyurethane with explosives such as pentaerythritol tetranitrate, because of the excessive exothermic heat generated during formation of such a molded foam explosive.

SUMMARY OF THE INVENTION

The present invention comprises a method and composition for forming a molded foamed polyurethane explosive block with pentaerythritol tetranitrate (PETN) in a manner in which the generation of excessive exothermic heat is inhibited during the reaction to form the foamed polyurethane. In one aspect of the invention, the exothermic heat generation is controlled by the use of non-reactive filler materials. In a preferred embodiment the filler further imparts fire retardant properties to the resultant molded foam explosive block. In another aspect of the invention, the reactants are introduced into a mixing chamber by remote control, wherein the mold itself forms a bottom wall of the mixing chamber, and the remainder of the mixing chamber is portable and is removed from the mold, after the reactants and the pentaerythritol tetranitrate have been mixed together, to thereby eliminate the need to transfer the mixture from a mixing chamber into a mold while the thermosetting reactants are reacting to form the foamed polyurethane.

Other aspects of the invention will be apparent from the following description and accompanying drawings.

DETAILED DESCRIPTION OF THE INVENTION

Figure 1:
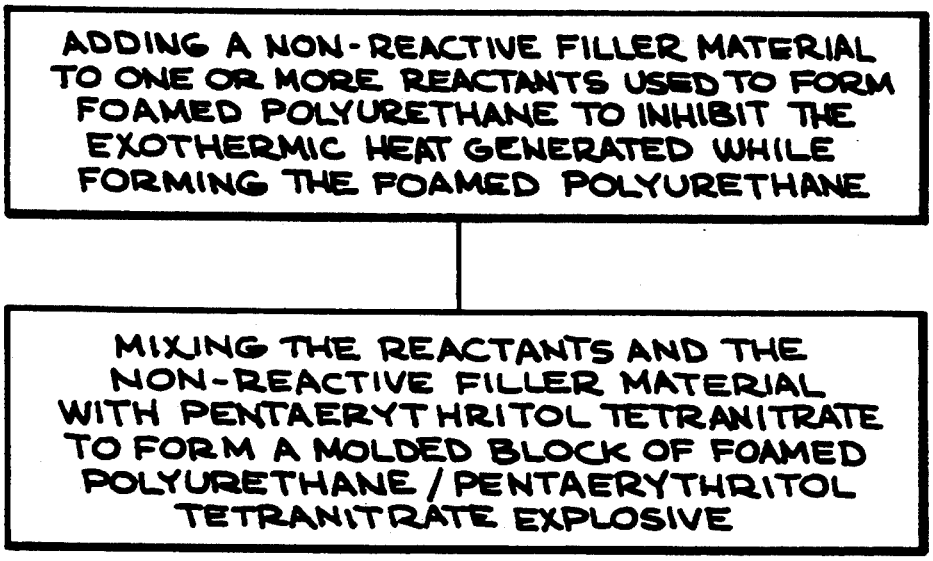
FIG. 1 is a flowsheet illustrating the process of the invention.

The molded foamed polyurethane/pentaerythritol tetranitrate explosive block of the invention is formed by first blending one or more non-reactive filler materials into one or both of the reactants used to form the foamed polyurethane. The two reactants and the pentaerythritol tetranitrate (PETN) are then mixed together in a portable mixing chamber which is temporarily located directly in the mold, as will be described below. The non-reactive filler material in one or both of the reactants sufficiently inhibits the exothermic heat generation to permit safe formation of the foamed polyurethane matrix in the present of the PETN explosive material.

The first and second reactants used to form the polyurethane, i.e., the A and B components, may respectively comprise any organic polyisocyanate and any organic polyol. Suitable organic polyisocyanates which may be used as the first reactant to form the desired foamed polyurethane, may include, for example, aliphatic diisocyanates, such as hexamethylene diisocyanate, and aromatic polyisocyanates, such as 2,4 -tolylene diisocyanate mixtures of 2,4 -tolylene diisocyanate and 2,6 -tolylene diisocyanate, m-phenylene diisocyanate,3,3'-bitolylene-4,4'-diisocyanate, diphenylene diisocyanate, diphenylmethane-4,4'diisocyanate, dianisidine, diisocyanate, 1,5-naphthalene diisocyanate, tri-(p-isocyanylphenyl)-methane, the triisocyanate adduct formed by reaction of 1 mole of hexanetriol and 3 moles of m-tolylene diisocyanate, and the like.

Suitable organic polyols useful as the second reactant may include, for example, glycerol; trimethylol propane; butylene glycol; polyalkylene glycols, such as polyethylene glycol, polypropylene glycol, and polybutylene glycol; polyhydroxy polyesters, such as the reaction products of a polyhydroxy alcohol, e.g., glycerol, ethylene glycol, propylene glycol, polyethylene glycol, and trimethylol propane, with a polycarboxylic acid or anhydride, e.g., adipic acid, succinic acid, malonic acid, sebacic acid, diethylether dicarboxylic acid, maleic anhydride, and phthalic anhydride; esters of hydroxy carboxylic acids, such as castor oil and glyceryl monoricinoleate; polyhydroxy amino alcohols, such as, N,N,N',N'-tetrakis-(2-hydroxypropyl) ethylene aliamine (Quadrol), triethanol amine; and the like.

A catalyst may be included, if desired, in one of the reactants such as an amine catalyst or a metal salt catalyst. Examples of such catalysts include, for example, N-methyl morpholine, triethylene diamine, or triethyl amine, or metal salts, e.g., iron acetyl acetonate, lead naphthenate, cobalt naphthenate, zinc stearate, tributyl tin methacrylate, dibutyl tin dilaurate, dibutyl tin oxide, sodium stearate, sodium ricinoeate, sodium salicylate, sodium citrate, or the like.

The foaming agent used to foam the polyurethane as it forms may include a compound dispersed in one of the reactants which will decompose when exposed to the curing temperature to form one or more gases such as nitrogen or carbon dioxide. Examples of such blowing agents include azo-bis-isobutyro-nitrile; 1,1'azo-bis-(formamide); N,N'-dinitrosopentamethylene tetramine; N,N'-dimethyl-N,N'-dinitrosoterephthalamide; benzene sulfonyl hydrazide; ammonium and sodium carbonate and bicarbonate; and the like.

A carboxylic acid may also be incorporated into the polyol reactant as a blowing agent because of its reaction with an isocyanate to form carbon dioxide. Usually such a carboxylic acid will be a low molecular weight acid such as, for example, acetic acid, propionic acid, or betahydroxy propionic acid.

Generally speaking, any gas producing agent which may be initially incorporated into one of the two reactants, without reacting with that reactant, may be used as a blowing agent in the process of the invention.

The ratio or relative amounts of polyisocyanate (part A) versus polyol (part B) used to form the polyurethane will vary somewhat with the particular polyol and polyisocyanate used. Generally the ratio of the two reactants will vary from about 25 parts by weight polyisocyanate per about 75 parts by weight of polyol to 75 parts by weight polyisocyanate per 25 parts by weight polyol, i.e., from 25:75 to 75:25. Preferably, however, the weight ratio will be about 50:50.

The amount of PETN used with the polyurethane-forming reactants will vary from about 3 wt. % (based on total weight of the mixture) to 25 wt. % provide a density in the final foamed polyurethane explosive block of from about 0.06 to about 0.15 grams per $cm^3$ of PETN in the block.

It should be noted that when reactants are selected to form the polyurethane, including not only the organic polyol and the organic isocyanate, but also catalysts, blowing agents, etc., it is important that none of such materials be reactive with the PETN explosive at either ambient temperature or at the maximum exothermic temperature which will be attained during the formation of the foamed polyurethane. Such screening can be first carried out between the PETN and individual components, followed by a second level of screening of combinations of the other components with PETN to ensure that no synergistic effects will occur.

In accordance with one aspect of the invention, the non-reactive filler material, which is blended with one or both of the reactants prior to mixing of the reactants together in the portable mixing chamber, may comprise any powder which is non-reactive with either of the two reactants or the PETN. Examples of such non-reactive powders include talc, wood flour, aluminum, zinc, and monoammonium phosphate. Of these powders, the use of monoammonium phosphate is particularly preferred because its usage has been found to also impart fire retardant properties to the resultant molded foam polyurethane explosive blocks.

The amount of such non-reactive filler material, based on total weight of the two reactants and the PETN, will vary from about 5 wt. % to about 50 wt. %, and preferably will comprise from about 10 wt. % to about 30 wt. %. The exact amount of filler used may vary depending upon the particular reactants used. In general, the amount of filler material should be sufficient to limit the maximum exothermic temperature generated to not more than about 125° C., preferably not more than about 110° C., and most preferably not more than about 100° C. Optimum results have been obtained using from about 3 wt. % to about 10 wt. % of monoammonium phosphate which resulted in a maximum temperature increase to about 100° C. when used with a part A/part B mixture of polyisocyanate and polyol in a wt. ratio of 50 wt % polyisocyanate and 50 wt. % polyol.

The average particle size of the filler material may vary from about 325 mesh (Tyler) to about 16 mesh (Tyler), with about 200 mesh (Tyler) being an average powder size.

The two reactants and the PETN are blended together for a time period which may range from about 1 minute to about 5 minutes. The minimum time period is needed to ensure adequate mixing or blending of the two reactants and homogeneous dispersal of the PETN throughout mixture. The maximum time period is set by the reaction time which may vary from one formulation to another. It is important that the blended reactants be placed in the mold as rapidly as possible after the reaction commences. However, as will be explained below, in according with one aspect of the invention, blending of the reactants and the PETN may take place in a portable mixer placed in the mold itself, making such transfer of the mixture unnecessary.

Figure 2:
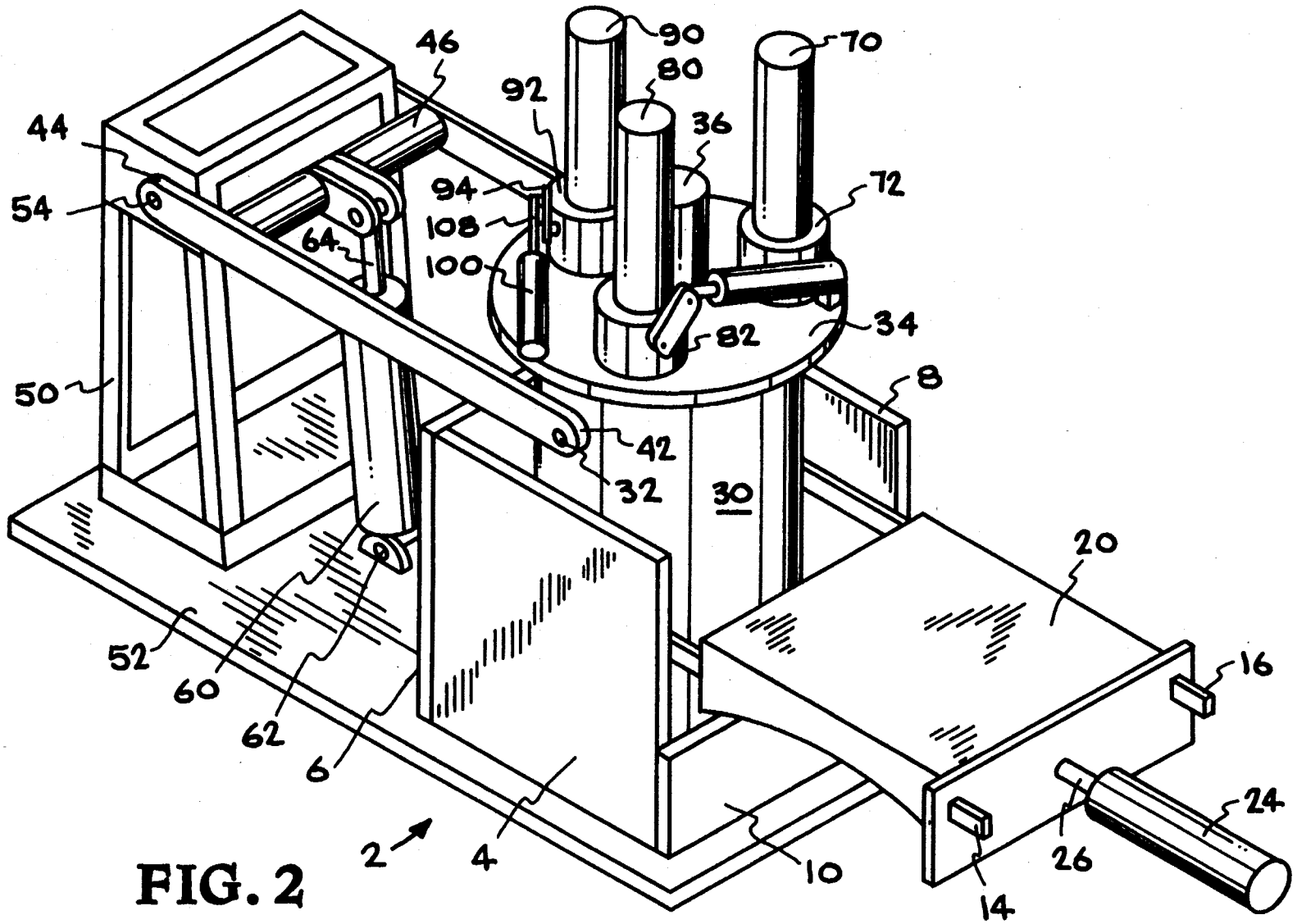
FIG. 2 is an isometric view of the apparatus used to remotely blend together, mix, and mold the foamed polyurethane/pentaerythritol tetranitrate explosive block.

Turning now to FIG. 2, in accordance with another aspect of the invention, the two reactants (including the non-reactive filler material in one or both reactants) and the PETN are remotely dispensed into a bottomless portable cylindrical mixer which, during the blending of the reactants and the PETN, is temporarily positioned within the mold itself (with the bottom of the mold serving as the bottom of the mixer), thereby eliminating the need for transferring the blended mixture from the mixer to the mold.

As shown in FIG. 2, a mold 2 having, in the illustrated embodiment, a generally rectangular shape, is provided with high sidewalls 4, 6, and 8, a fourth sidewall 10 of reduced height, and a solid bottom wall (not shown. Sidewall 10 is shorter than sidewalls 4-8 to permit a mold cover 20 to slide into mold 2 on rails 14 and 16, respectively carried on the inside of sidewalls 4 and 8. A first fluid power cylinder 24 is operationally connected to mold cover 20, via piston rod 26, to permit mold cover 20 to be moved back and forth from an open position (as shown) to a closed position with mold cover 20 moved into mold 2 against walls 4, 6, and 8, to thereby provide a generally sealed mold within which the foaming polyurethane can expand and fill as the polyol and polyisocyanate reactants react with one another to form the polyurethane.

Fluid power cylinder 24 is connected by appropriate tubing (not shown) to a remote fluid power source (also not shown) and cylinder 24 may, therefore, be controlled remotely for safety reasons as needed or desired.

Figure 4:
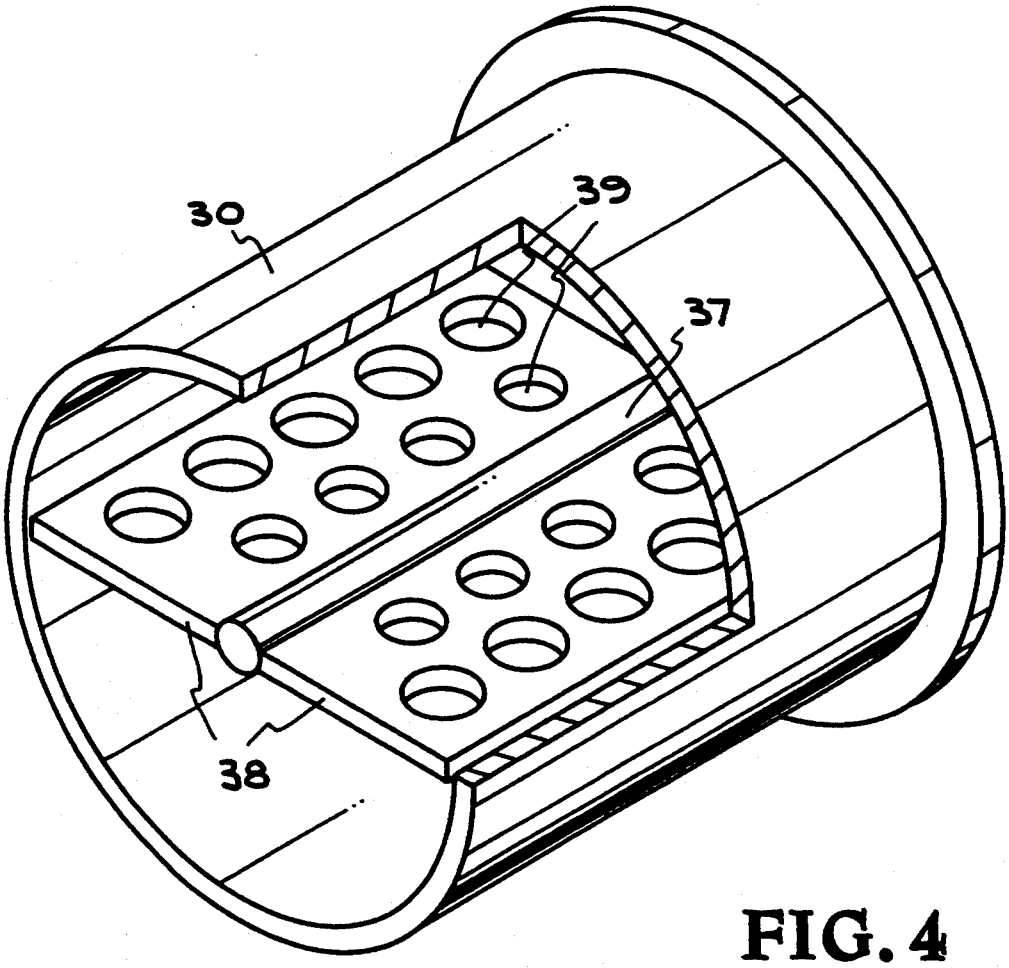
FIG. 4 is an isometric bottom view of the bottomless mixing cylinder, showing one embodiment of the mixing cylinder paddle therein.

As shown in FIG. 2, a removable cylindrical mixer 30 is shown positioned within mold 2. As best seen in FIG. 4, portable mixer 30 has no bottom, but instead rests on the bottom wall of mold 2 which serves as the bottom wall of portable mixer 30 when mixer 30 is mounted within mold 2. The weight of mixer 30 serves to provide a sufficient seal between mixer 30 and the bottom wall of mold 2, eliminating any need for special sealing means such as o-rings or the like. Pivotally mounted to opposite sides of cylindrical mixer 30 at 32 are first ends 42 of a pair of arms 40. Each arm 40 has an opposite end 44 mounted to a frame 50 at 54. A second fluid power cylinder 60 is mounted at a first end 62 to a base portion 52 of frame 50. Cylinder 60 is operationally attached, at its opposite end, to a cross arm 46 via piston rod 64. Cross arm 46 extends between the two arms 40 about midway between first end 42 and opposite end 44 of each arm 40.

When second fluid power cylinder 60 is actuated, arms 40 are raised, thereby raising portable mixer 30 out of mold 2. First fluid power cylinder 24 may then be actuated to move sliding cover 20 into mold 2.

Fluid power cylinder 60 is also connected by appropriate tubing (not shown) to a remote fluid power source (also not shown) and cylinder 60 may also, therefore, be controlled remotely for safety reasons as needed or desired similarly to the remote control of fluid power cylinder 24.

Second fluid power cylinder 60 is actuated to remove portable mixer 30 from mold 2 after the two reactants (and the non-reactive filler previously mixed with one or both reactants) have been blended with one another and with the PETN in mixer 30.

Figure 3:
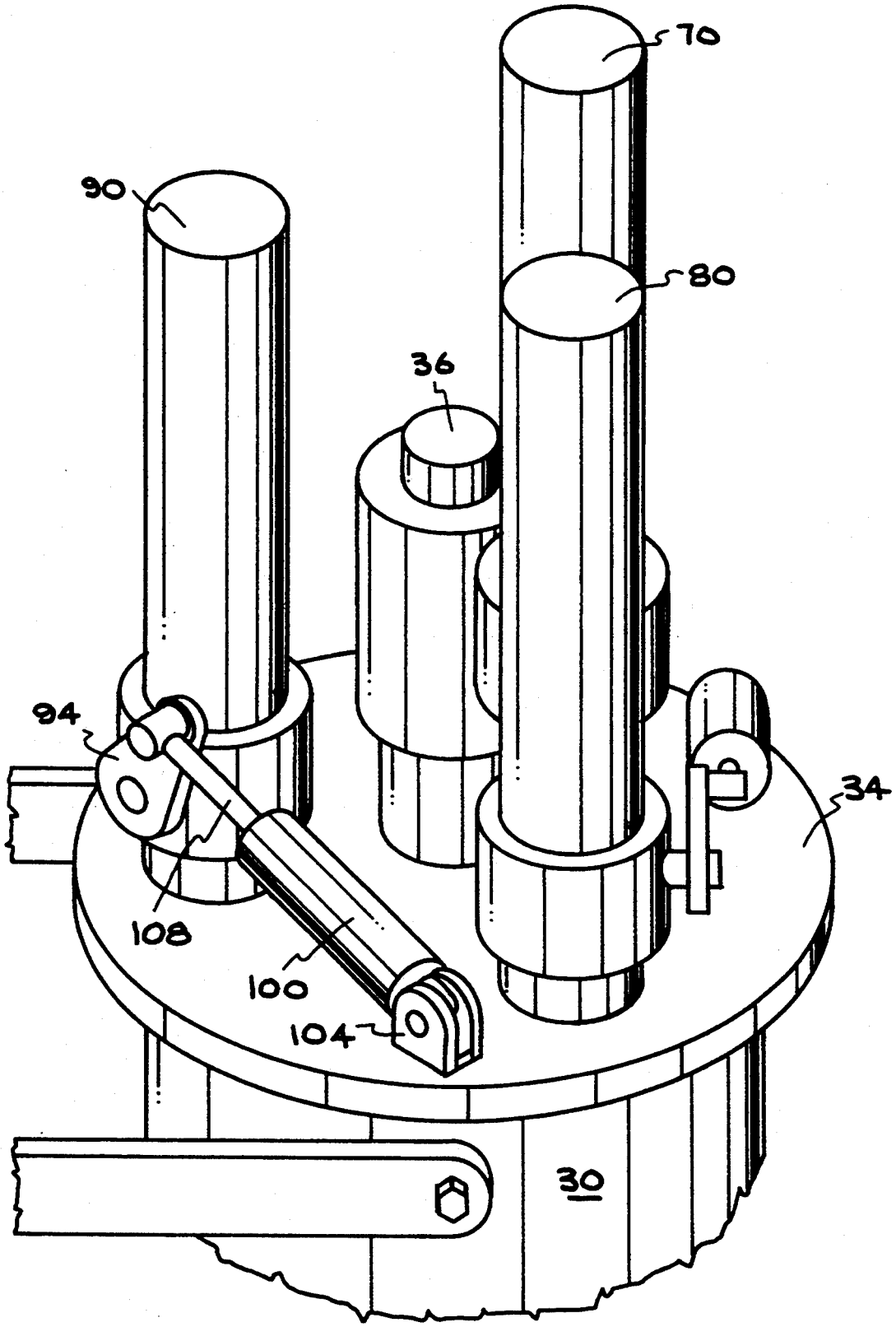
FIG. 3 is an isometric view of a portion of the apparatus shown in FIG. 2.

In order to blend the two reactants and the PETN in mixer 30, each of the three must be dispensed into mixer 30. To accomplish this remotely, mixer 30 is provided with a cover 34, which may comprise a flat plate. Three reservoirs 70, 80 and 90, are each mounted on mixer cover 34. As shown in FIGS. 2 and 3, reservoirs 70, 80, and 90 may comprise open tubular or cylindrical members which are respectively fitted, at their lower ends, into vanes 72, 82, and 92 which may, in turn, be threadedly received in threaded openings in mixer cover 34.

Referring now in particular to FIG. 3, each of the valves 72, 82, and 92 is actuated by a fluid power cylinder to move the valve from a shut position to an open position whereby the contents of the particular reservoir may be emptied into mixer 30.

Since each of the valves 72, 82, and 92, and the fluid power cylinders attached thereto are identical, and each fluid power cylinder is attached to the respective valve in an identical manner, a description of the operation of fluid power cylinder 100 shown in FIG. 3 operationally attached to valve 92 will suffice for all three valves.

Fluid power cylinder 100 is attached at a first end 104 to mixer cover 34 and is operationally attached via piston rod 108 to a lever 94 on valve 92. When fluid power cylinder 100 is actuated to extend piston rod 108, rod 108 moves lever 94 to open valve 92, as shown in FIG. 2. When fluid power cylinder 100 is actuated to retract piston rod 108, rod 108 moves lever 94 in the opposite direction to close valve 92.

The other valves 72 and 82 are operated by their respective fluid power cylinders in the same manner to respectively open and shut valves 72 and 82 to thereby respectively empty the contents of reservoirs 70 and 80 into mixer 30.

It should be noted, in this regard, that valves 72, 82, and 92 may be opened simultaneously or sequentially in any predetermined order, depending upon the particular reactants being used, reactivity of same, the viscosity of same, etc. As with first fluid power cylinder 24 and second fluid power cylinder 60, actuation of the fluid power cylinders respectively attached to valves 72, 82, and 92 (illustratively represented by fluid power cylinder 100) may be carded out from a remote location for safety reasons.

Also mounted on cover plate 34 is a stirrer motor 36. Stirrer motor 36 is connected via rod 37 to a stirrer blade or paddle 38, as best seen in FIG. 4, which may comprise a flat blade with a plurality of holes 39 formed in paddle blade 38. Alternatively, a high pitch propeller blade may be substituted for illustrated blade 38.

To further illustrate the invention, 300 grams of monoammonium phosphate were blended with 900 grams of a diphenylmethane diisocyanate (part A) and loaded into reservoir 70. 300 grams of monoammonium phosphate were also blended with 900 grams of a polyether/polyester polyol (part B) and loaded into reservoir 80. 1190 grams of PETN was loaded into reservoir 90. Fluid power cylinder 24 was actuated to remove mold cover 20 from mold 2 and fluid power cylinder 60 was then actuated to lower mixer 30 into mold 2 to rest on the bottom of mold 2.

Valves 72, 82, and 92 were then opened by actuation of their respective fluid power cylinders to unload the contents of reservoirs 70, 80, and 90 into mixer 30. Valves 72 and 82 were actuated first, and then, after a few seconds, valve 92 was also actuated to blend the PETN into the polyurethane mixture. The mixture was then blended together for about 2 minutes.

Fluid power cylinder 60 was then actuated to remove portable mixer from mold 2, leaving the blended mixture in mold 2 (because of the bottomless design of mixer 30). Fluid power cylinder 24 was then actuated to insert mold cover 20 in place in mold 2 and the reaction was allowed to proceed, while the temperature was monitored. The temperature did not rise above 100° C. during the reaction in mold 2. After 30 minutes, the temperature began to drop indicating the reaction was slowing. After 120 minutes the mold was opened and a 9.75 inch high molded block of foamed polyurethane PETN explosive having a 1 ft. square base was removed from the mold. The foam block had a density of about 0.3 grams/cm$^3$ and, when detonated, developed a detonation pressure of 4 kilobars.

To test the stability of the foamed explosive block, a 10 kilogram weight was dropped onto the block at successive heights of up to 50 cm. without detonation occurring. In contrast, detonation occurred when a 2 kilogram weight was dropped a distance of 17 cm. on a control block of pure PETN During a second evaluation, the foamed polyurethane block of explosive was dropped a distance of six feet onto a concrete floor. A comer of the block broke off, but no detonation occurred.

To test the fire retardancy of the monoammonium phosphate (MAP) filler in the foam block of polyurethane explosive, the following tests were carried out. First a 12 inch×12 inch×6 inch thick block containing 6 volume % PETN and 3 volume % MAP was ignited. The block took about 2 minutes to be fully consumed. Then another block of the same size containing 6 volume % PETN, but no MAP, was ignited. This block took only about 15 seconds to be fully consumed.

The explosive block was then detonated by the standard procedure of placing two layers of DuPont Detasheet booster explosive over the top of a 12 inch×12 inch×6 inch thick block of the polyurethane/PETN explosive with a standard detonator. An aluminum witness plate placed under the explosive block indicated a reasonably uniform indentation over a square area that closely matched the 1 foot square base of the explosive block.

The density distribution of PETN within the foam block was determined by cutting a foam block sample into 05. inch cubes. Because it was not safe to cut an actual dilute explosive foam block containing PETN, PETN was simulated in the original mix using either chalk or talc powder. A statistical evaluation of the weights of the small cube samples showed that the density inside the core of the foam block was constant to within the 5% estimated uncertainty in the measurements. Next to the outside surfaces, however, a skin was observed with approximately 2 to 3 times higher density. This skin was typically less than 0.2 inch thick, except near the comers where slightly larger high-density regions were observed. The skin had a glossy finish and a much lower porosity than the core. The lower skin density is desirable because it makes the dilute explosive foam block more water resistant.

Thus, the invention provides a process and composition which controls the amount of heat generated during the exothermic reaction which results in the formation of the molded foamed polyurethane/pentaerythritol tetranitrate block of explosive; and apparatus which permits the reactants and pentaerythritol tetranitrate explosive components to be blended together in situ in a mold using a bottomless portable mixer which is placed in the mold (which serves as the bottom of the mixer) to permit the components to be blended in the mixer and the mixer then removed from the mold, leaving the blended components in the mold.

Having thus described the invention what is claimed is:

1. A process for forming a molded foamed polyurethane explosive block with pentaerythritol tetranitrate in a manner in which the generation of excessive exothermic heat is inhibited during the reaction to form the foamed polyurethane which comprises controlling said exothermic heat generation using one or more non-reactive filler materials added to a mixture comprising:

a) reactants used to form said foamed polyurethane; and b) said pentaerythritol tetranitrate.

2. The process of claim 1 wherein said step of using said one or more non-reactive filler materials to inhibit said exothermic heat generation further comprises adding a sufficient amount of said one or more non-reactive filler material to one or more components of said mixture to limit the maximum exothermic temperature generated during said reaction to form said foamed polyurethane to less than 125° C.

3. The process of claim 2 wherein said step of using said one or more non-reactive filler materials to inhibit said exothermic heat generation further comprises adding to one or more components of said mixture a total of from about 5 wt. % to about 50 wt. % of said one or more nonreactive filler materials, based on the total weight of said mixture.

4. The process of claim 2 wherein said step of using non-reactive filler materials to inhibit said exothermic heat generation further comprises adding to one or more components of said mixture a total of from about 1.0 wt. % to about 30 wt. % of said one or more non-reactive filler materials, based on the total weight of said mixture.

5. The process of claim 1 wherein said step of using said one or more non-reactive filler materials to inhibit said exothermic heat generation further comprises adding one or more non-reactive filler materials to said mixtures selected from the group consisting of particulate talc, wood flour, aluminum, zinc, and monoammonium phosphate.

6. A molded foamed polyurethane explosive block with pentaerythritol tetranitrate formed with one or more non-reactive filler materials in an amount sufficient to limit the maximum temperature generated to not more than about 125° C. and within a range of from about 1.0 wt. % to about 50 wt. %, based on the total weight of said block to thereby inhibit the generation of excessive exothermic heat during the reaction to form said foamed polyurethane explosive block.

7. A process for forming a molded foamed polyurethane explosive block with pentaerythritol tetranitrate in a manner in which the generation of excessive exothermic heat is inhibited during the reaction to form the foamed polyurethane which comprises controlling said exothermic heat generation by adding to a mixture comprising:

a) reactants used to form said foamed polyurethane; and b) said pentaerythritol tetranitrate;

one or more non-reactive filler materials selected from the group consisting of particulate talc, wood flour, aluminum, zinc, and monoammonium phosphate in an amount sufficient to limit the maximum temperature generated to not more than about 125° C. and within a range of from about 1.0 wt. % to about 50 wt. %, based on the total weight of said mixture.

8. The process of claim 7 wherein said step of using said one or more non-reactive filler materials to inhibit said exothermic heat generation further comprises adding from about 10 wt. % to about 30 wt. % of said one or more non-reactive filler materials, based on the total weight of said mixture, to one or more components of said mixture.

9. The molded foamed polyurethane explosive block of claim 6 wherein said one or more non-reactive filler materials have a particle size ranging from about 325 mesh (Tyler) to about 16 mesh (Tyler).

10. A process for forming a molded foamed polyurethane explosive block with pentaerythritol tetranitrate which comprises:

a) introducing into a mixing chamber by remote control, wherein a mold forms a bottom wall of said mixing chamber, and the remainder of said mixing chamber is portable and removable from said mold;

i) reactants used to form said foamable polyurethane, including one or more non-reactive filler materials used to control the exothermic heat generated during the reaction to form said polyurethane; and ii) pentaerythritol tetranitrate;

b) blending together said reactants used to form said foamable polyurethane, said one or more non-reactive filler materials, and said pentaerythritol tetranitrate in said portable mixing chamber; and c) removing said portable mixing chamber from said mold.

11. The process of claim 10 which further includes the step of placing a mold cover over said mold after said step of removing said portable mixer from said mold.

12. A molded foamed polyurethane explosive block with pentaerythritol tetranitrate formed with one or more non-reactive filler materials added to inhibit the generation of excessive exothermic heat during the reaction to form the foamed polyurethane explosive block.

13. The foamed polyurethane explosive block with pentaerythritol tetranitrate of claim 12 wherein said one or more non-reactive filler materials comprise from about 5 wt. % to about 50 wt. %, based on the total weight of said block.

14. The foamed polyurethane explosive block with pentaerythritol tetranitrate of claim 13 wherein said one or more non-reactive filler materials comprise from about 10 wt. % to about 30 wt. %, based on the total weight of said block.

15. The foamed polyurethane explosive block with pentaerythritol tetranitrate of claim 13 wherein said one or more non-reactive filler materials consist essentially of from about 5 wt. % to about 50 wt. % monoammonium phosphate, based on the total weight of said block, to impart fire-retardant properties to said block as well as to inhibit said exothermic heat generation during formation of said block.

16. A process for forming a molded foamed polyurethane explosive block with pentaerythritol tetranitrate in a manner in which the generation of excessive exothermic heat is inhibited during the reaction to form the foamed polyurethane which comprises controlling said exothermic heat generation by adding to a mixture comprising:

a) reactants used to form said foamed polyurethane; and b) said pentaerythritol tetranitrate; one or more non-reactive filler materials in an amount sufficient to limit the maximum temperature generated to not more than about 125° C. and within a range of from about 1.0 wt. % to about 50 wt. %, based on the total weight of said mixture.

17. A process for forming a molded foamed polyurethane explosive block with pentaerythritol tetranitrate in a manner in which the generation of excessive exothermic heat is inhibited during the reaction to form the foamed polyurethane which comprises forming a mixture of:

a) reactants used to form said foamed polyurethane;

b) said pentaerythritol tetranitrate; and c) a sufficient amount of said one or more non-reactive filler materials, including monoammonium phosphate, to limit the maximum exothermic temperature generated during said reaction to form said foamed polyurethane to less than 125° C., and to further impart fire retardant properties to said molded foamed polyurethane explosive block with pentaerythritol tetranitrate.

18. A process for forming a molded foamed polyurethane explosive block with pentaerythritol tetranitrate in a manner in which the generation of excessive exothermic heat is controlled during the reaction to form the foamed polyurethane which comprises:

a) forming a mixture comprising:

i) reactants used to form said foamed polyurethane; and ii) said pentaerythritol tetranitrate; and b) adding to said mixture from about 1.0 wt. % to about 50 wt. %, based on the weight of said mixture, of one or more non-reactive filler materials, having a particle size ranging from about 325 mesh (Tyler) to about 16 mesh (Tyler), to control said exothermic heat generation, including monoammonium phosphate to further impart fire retardant properties to said molded foamed polyurethane explosive block with pentaerythritol tetranitrate;

whereby said one or more non-reactive filler materials will inhibit said exothermic heat generation during said formation of said molded foamed polyurethane explosive block with pentaerythritol tetranitrate.

19. The process of claim 1 wherein said one or more non-reactive filler materials have a particle size ranging from about 325 mesh (Tyler) to about 16 mesh (Tyler).

20. The process of claim 7 wherein said one or more non-reactive filler materials have a particle size ranging from about 325 mesh (Tyler) to about 16 mesh (Tyler).

* * * * *